US007017215B1

(12) United States Patent
Singer et al.

(10) Patent No.: US 7,017,215 B1
(45) Date of Patent: Mar. 28, 2006

(54) SUPPORT FOR EXTENDED ARMS OF A PERSON LYING ON THEIR SIDE

(76) Inventors: Adam Joel Singer, 17 Hacienda Rd., Bell Canyon, CA (US) 91307; Arthur Starr, 16131 Clear Oak Dr., Encino, CA (US) 91436

( * ) Notice: Subject to any disclaimer, the term of this patent is extended or adjusted under 35 U.S.C. 154(b) by 0 days.

(21) Appl. No.: 10/993,810

(22) Filed: Nov. 20, 2004

(51) Int. Cl.
*A47C 20/08* (2006.01)

(52) U.S. Cl. ..... 5/646

(58) Field of Classification Search ..... 128/877–879; 5/646, 647, 623, 652, 655.9, 922
See application file for complete search history.

(56) References Cited

U.S. PATENT DOCUMENTS

| | | | | |
|---|---|---|---|---|
| 561,562 | A | 6/1896 | Brownson et al. | |
| 2,765,480 | A * | 10/1956 | Mueller | 5/640 |
| 3,046,072 | A | 7/1962 | Douglass, Jr. et al. | |
| 4,045,011 | A | 8/1977 | Ford | |
| 4,270,235 | A | 6/1981 | Gutmann | |
| 4,745,648 | A * | 5/1988 | Viesturs | 5/678 |
| D321,562 | S | 11/1991 | Ljungvall | |
| 5,443,233 | A * | 8/1995 | Kabanek | 248/118 |
| D382,057 | S | 8/1997 | Swedberg et al. | |
| 5,940,912 | A | 8/1999 | Keselman | |
| D413,982 | S | 9/1999 | Swedberg et al. | |
| D415,281 | S | 10/1999 | Swedberg et al. | |
| D426,307 | S | 6/2000 | Swedberg et al. | |
| 6,490,742 | B1 * | 12/2002 | Hall et al. | 5/630 |
| 6,578,218 | B1 * | 6/2003 | Wassilefsky | 5/648 |
| 6,622,727 | B1 | 9/2003 | Perry | |

OTHER PUBLICATIONS

Hamilton, Blake D.: Transperitoneal Laparoscopic Adrenalectomy, Urologic Clinics of North America, Feb. 2001, pp. 61-70, vol. 28 #1, W.B. Saunders Co., Philadelphia, PA. USA.

* cited by examiner

*Primary Examiner*—Jong-Suk (James) Lee
*Assistant Examiner*—Gilbert Lee

(57) ABSTRACT

A bottom cushion (12) and a top cushion (13) are rectangular and have top furrows so that when stacked they can support and provide access to the arms generally perpendicular to a patient lying on their side. In addition the bottom cushion (12) and the top cushion (13) have cut-off corners (21, 22 and 31, 32), respectively, which align to provide access to the nasal and oral cavities during surgical procedures performed in these positions.

8 Claims, 3 Drawing Sheets

SUPPORT FOR EXTENDED ARMS OF A PERSON LYING ON THEIR SIDE

CROSS-REFERENCE TO RELATED APPLICATION

Not Applicable

FEDERALLY SPONSORED RESEARCH

Not Applicable

SEQUENCE LISTING OR PROGRAM

Not Applicable

BACKGROUND OF THE INVENTION

1. Field of Invention

The present invention relates generally to patient support systems, specifically to cushions that stack for use in supporting both arms of a patient lying on their side.

2. Prior Art

There are a multitude of surgical procedures that require a patient to be lying on their side (laterally) and semi-side (semi-lateral positions) on an operating table where one arm is placed above the other. Unhindered access to the arms and nasopharyngeal (nasal and oral) cavities of the patient during surgical procedures conducted in lateral and semi-lateral positions is critically important for purposes of placement, removal, and maintenance of a multitude of medical devices. For example, medical devices such as vascular access lines, physiological monitoring devices, and tubes are often used. To affect these positions and hold the patient's arms in an extended position generally perpendicular to the torso, both arms are commonly surrounded with towels and other padding; and straps and tape are commonly used to bind both arms to the arm board. Although such padding and encircling binders attach the arms to the arm board, this is not safe and does not buttress the many pressure points of the arms. It is time consuming to set up and highly unsatisfactory and potentially harmful because arm boards are designed to support only one arm. This is illustrated in U.S. Pat. No. 4,045,011 to Ford (1977) and U.S. Pat. No. 5,940,912 to Keselman (1999).

Other time consuming, unsatisfactory, and potentially harmful practices are used to support the upper arm, while still using the arm board to support the lower arm. These include the use of a rollaway table, stand, shelf, and other devices not specifically designed to support the arms.

Still other potentially harmful and time consuming practices to support the upper arm use assemblies constructed of metal and other hard parts consisting of joint couplings and posts that attach a second arm board to the operating table as shown in U.S. Pat. No. 3,046,072 to Douglass, et. al. (1972) or the arm board as described in Hamilton, B. D.: Transperitoneal Laparoscopic Adrenalectomy. *Urologic Clinics of North America,* 28 (1): page 63, February 2001. Significant injury from bodily contact may result due to contact with one of the many hard parts during placement, positioning and removal of these devices. Injury can also occur as a result of an improperly fixed position of the upper arm relative to the body and from unintended malfunction, potential failure, and collapse of parts.

The prior art is replete with cushions having grooves or ridges that support one arm. U.S. Pat. No. 561,652 to Brownson, et. al. (1896) describes a grooved armrest cushion that supports only one arm of telegraph operators, thereby preventing and alleviating paralysis of the arm. U.S. Pat. No. D321,562 to Ljungvall (1991) describes a grooved arm pillow that supports only one arm for measuring blood pressure. U.S. Pat. Nos. D382,057 (1997), D413,982 (1999), D415,281 (1999), and D426,307 (2000), all to Swedberg, et. al. describe a grooved cushion hand support, a grooved arm positioning splint, a grooved arm with hand positioning splint, and a grooved arm splint with hand positioner, respectively, all being able to support only one arm. U.S. Pat. No. 4,270,235 to Gutmann (1981) describes an arm pillow with ridges on either side designed to support one arm in post-surgical convalescence patients reclining in the spine position. Although the ridges prevent the arm from rolling off the pillow in a manner similar to the operation of grooved cushions, the device is intended to support only one arm.

U.S. Pat. No. 6,622,727 to Perry (2003) describes cushions where a recessed wedge pillow and recessed arm cushions support a head, neck, and both arms. The device is designed to maintain the patient in the "sniffing angle" in the supine position on the operating table for endotracheal anesthesia.

U.S. Pat. No. 6,490,742 to Hall, et. al. (2002) describes a plurality of stackable bolsters for purposes of elevating only one leg or one arm to a desired height.

Heretofore, all prior art devices that we are aware of do not provide well-distributed support, security, safety and padding of the pressure points for both arms, one on top of the other, off the side of the operating table. Furthermore, no prior art device provides access to the arms and nasopharyngeal cavities during surgical procedures performed in these positions.

BACKGROUND OF THE INVENTION—OBJECTS AND ADVANTAGES

Accordingly, several objects and advantages of the present invention are:

(a) to provide a device that supports the arms of the patient in the lateral or semi-lateral position wherein both arms are placed one above the other off the side of the operating table;

(b) to prevent bodily injury that may be caused by harmful techniques such as the use of encircling binders surrounding padded arms attached to the arm board of the operating table for the patient in the lateral or semi-lateral position;

(c) to prevent bodily injury that may be caused by the use of rollaway tables, stands, shelves, and other devices not specifically designed to support the arms of the patient in the lateral or semi-lateral position;

(d) to prevent bodily injury from contact with one of the many metal or other hard parts of other devices during placement, positioning, and removal of these devices; during the surgical procedure as a result of an improperly fixed position of the arms relative to the body; and from unintended malfunction, potential failure, and collapse of one or more integral parts of these devices;

(e) to provide a rapid method for supporting the patient's arms so that the highest degree of safety, stability, and padding for both upper extremities is achieved;

(f) to provide and maintain unhindered access at all times to the arms as well as nasopharyngeal cavities during surgical procedures.

Further objects and advantages will become apparent from consideration of the ensuing description and the accompanying drawings.

SUMMARY OF THE INVENTION

In accordance with the present invention, two stackable cushions each comprise a base having a top surface with a furrow for arm support. Each cushion has cut-off corners that provide access to the arms and nasopharyngeal cavities during surgical procedures performed in lateral and semi-lateral positions. The cushions are stacked, one on top of the other, with the bottom cushion attached to an arm board and the top cushion attached to the bottom cushion.

DRAWINGS—FIGURES

DRAWINGS—REFERENCE NUMERALS

Figure 1:
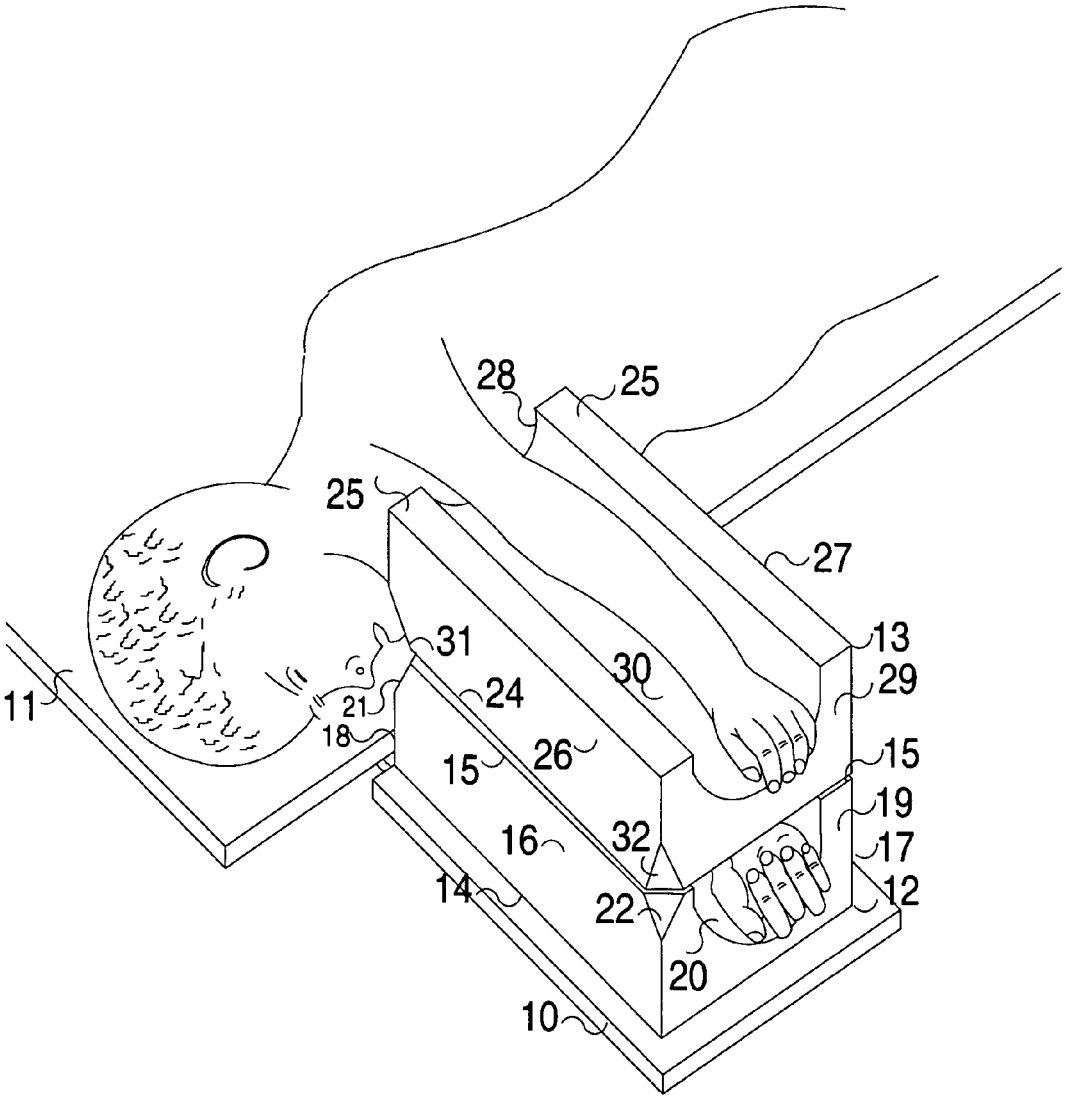
FIG. 1 is a perspective view a patient with both arms in a pair of stacked cushions attached to an arm board of an operating table according to one preferred embodiment of the present invention.

10 Arm board
11 Operating table
12 Bottom cushion
13 Top cushion
14 Under side of bottom cushion
15 Top side of bottom cushion
16 Cephalic side of bottom cushion
17 Caudal side of bottom cushion
18 Inner side of bottom cushion
19 Outer side of bottom cushion
20 Furrow of bottom cushion
21 Inner triangular cut off corner of bottom cushion
22 Outer triangular cut off corner of bottom cushion
23 Strips of hook and loop fasteners on the top side of the bottom cushion
24 Under side of bottom cushion
25 Top side of top cushion
26 Cephalic side of top cushion
27 Caudal side of top cushion
28 Inner side of top cushion
29 Outer side of top cushion
30 Furrow of top cushion
31 Inner triangular cut off corner of top cushion
32 Outer triangular cut off corner of top cushion

DETAILED DESRIPTION—FIGS. 1–3—PREFERRED EMBODIMENT

A preferred embodiment of a set of stacked furrowed cushions for supporting the arms of a patient lying on their side with their arms extended generally perpendicular to their body with one arm above the other is illustrated in FIG. 1. A conventional arm board 10 is attached to a conventional operating table 11. A bottom cushion 12 and a top cushion 13 are stacked on top of each other, with bottom cushion 12 adhered to arm board 10. Cushions 12 and 13 are constructed of high resilient foam rubber or other suitable viscoelastic cushioning with or without a soft fabric cover (removable or permanent) that may be manufactured through methods well known in the art.

Figure 2:
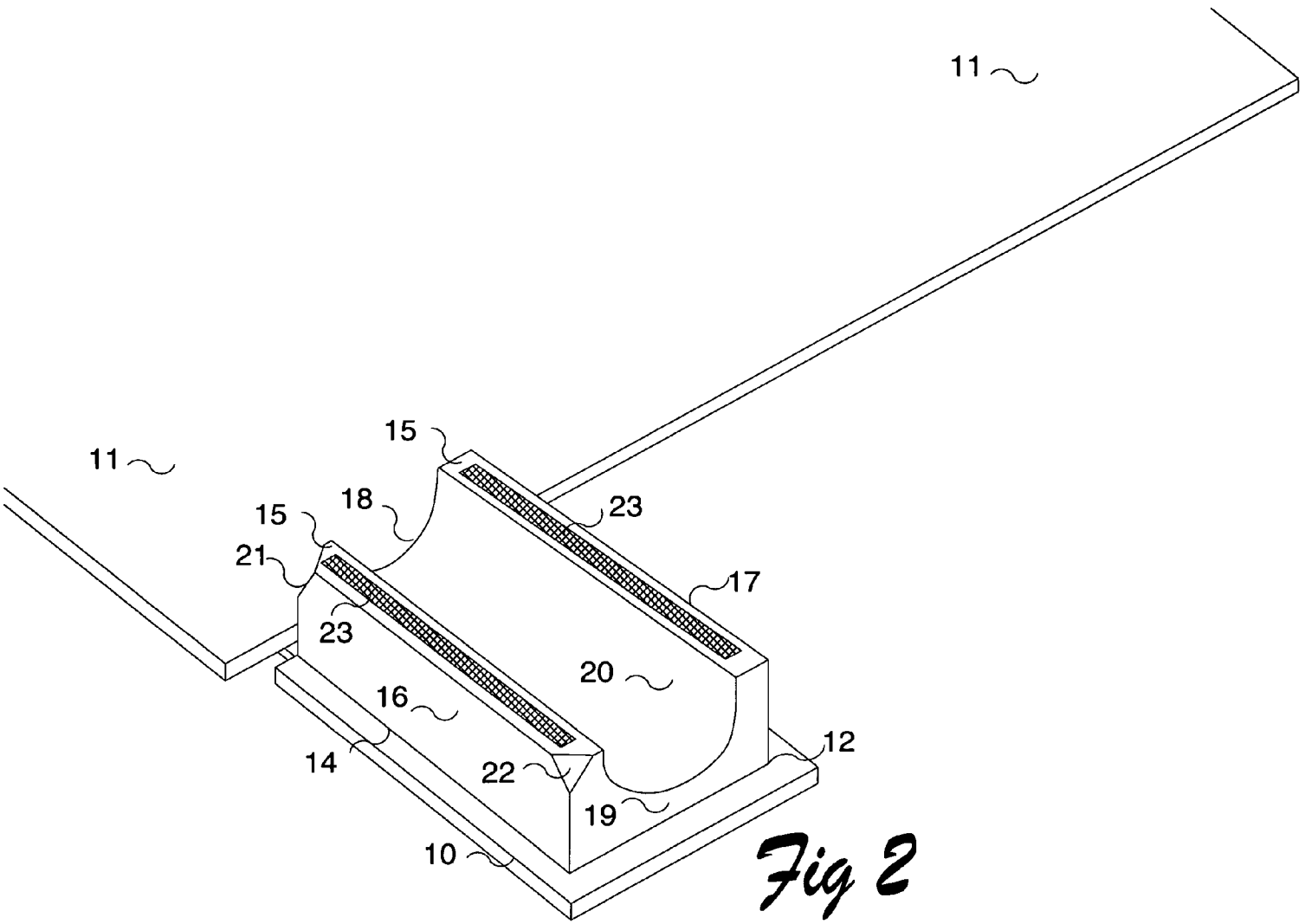
FIG. 2 is a perspective view of the bottom cushion of FIG. 1.

In reference to FIG. 2 bottom cushion 12 consists of an under side 14, a top side 15, a cephalic (head) side 16, a caudal (tail or bottom) side 17, an inner end 18, and an outer end 19. Cushion 12 has approximate overall dimensions of 50 cm×22 cm×29 cm (rectangular shape) with a furrow, groove, trough, or cradle 20, an inner triangular cut off corner 21, and an outer triangular cut off corner 22. Under side 14 is placed contiguous to arm board 10 and is secured by a strip of hook-and-loop fasteners (not shown). The surface area of bottom side 14 is similar to the surface area of arm board 10. Furrow 20 extends from inner end 18 to outer end 19. Furrow 20 is typically 50 cm×17 cm×13 cm and has sufficient cross-sectional area to support (FIG. 1) and allow the patient insert their lower arm into furrow 20. The depth of furrow 20 is designed to be at the same level as the surface of table 11 when table 11 is padded. Cut off corners 21 and 22 are on top side 15. Strips of hook-and-loop fasteners 23 extend along both of the non-furrowed regions of top side 15.

Figure 3:
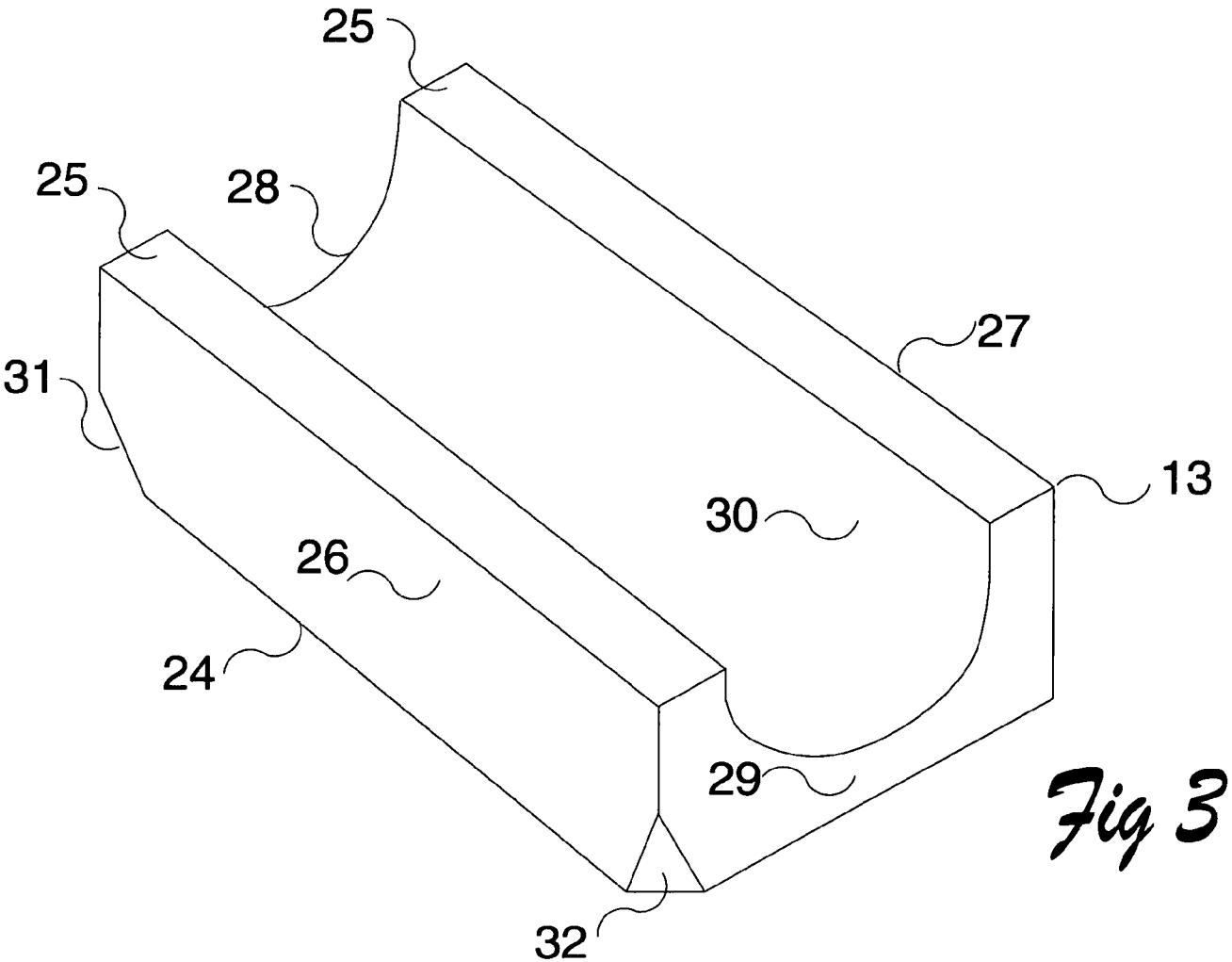
FIG. 3 is a perspective view of the top cushion of FIG. 1.

In reference to FIG. 3 top cushion 13 consists of an under side 24, a top side 25, a cephalic (head) side 26, a caudal (tail or bottom) side 27, an inner end 28 and an outer end 29. Top cushion 13 has approximate overall dimensions of 50 cm×22 cm×29 cm (rectangular shape) with a furrow, groove, trough, or cradle 30, an inner triangular cut off corner 31, and outer triangular cut off corner 32. Under side 24 stacks on top side 15 of bottom cushion 12 so that cut off corner 21 aligns with cut off corner 31 and cut off corner 22 aligns with cut off corner 32, thereby forming two diamond shaped recesses (FIG. 1). Two strips of hook-and-loop fasteners (not shown) on under side 24 are located like a mirror image to two strips of hook-and-loop fasteners 23 on top side 15 of bottom cushion 12 when cushions 12 and 13 are stacked and aligned. These two sets of hook-and-loop fasteners come in direct contact and contiguous so that they are sandwiched between bottom cushion 12 and top cushion 13. Furrow 30 extends from inner end 28 to outer end 29. Furrow 30 is typically 50 cm×17 cm×9 cm and has sufficient cross-sectional area to support (FIG. 1) and allow the patient insert their upper arm into furrow 30. The distance between the depth of furrow 30 to the under side 24 is approximately the distance between the inner aspects of the patient's arm pits and can be selected to match the size of the patient.

Operation—FIGS. 1–3

The stackable cushions are used to support one of the patient's arms in furrow 20 of bottom cushion 12 and the other arm in furrow 30 of top cushion 13 with the patient, awake or unconscious, in the lateral or semi-lateral position as shown in FIG. 1. Top cushion 13 adheres to bottom cushion 12 and bottom cushion 12 adheres to arm board 10 all by hook-and-loop strips. In turn, arm board 10 is positioned near the upper end on either side of table 11 to support the arms of the patient. Namely, the right and left arms are lower and upper, respectively, for the patient resting on their right side; the left and right arms are the lower and upper, respectively, for the patient resting on their left side. Importantly, both arms are supported safely and padded optimally at all times in their respective furrowed cushions 12 and 13 during adjustable movements.

Furrow 20 of bottom cushion 12 and furrow 30 of top cushion 13 have sufficient cross-sectional area to support, pad, and provide access to each arm when resting within their respective furrows and cushions 12 and 13 are stacked. The depth of furrow 20 is at the same level as the top surface of table 11.

The diamond shapes formed by aligning triangular cut off corners 21 to 31 and 22 to 32 provide access to the nasal and oral cavities for the purposes of placement, removal and maintenance of a multitude of medical devices, such as tubes and monitoring devices that are placed through the nasal and oral cavities during surgical operations.

Straps (not shown) may encircle arm board 10 and stacked cushions 12 and 13 to hold them together as a unit and protect the arms from falling out of their respective furrows.

CONCLUSIONS, RAMIFICATIONS, AND SCOPE

Accordingly the reader will see that, according to the invention, we have provided a pair of stacked furrowed cushions that attach to an arm board off the side of an operating table that support both arms generally perpendicular to a patient's body when lying on their side. In addition, the cut off corners of our stacked cushions provide and maintain unhindered access at all times to the arms and nasopharyngeal cavities during surgical procedures. Our cushions are constructed of high resilient foam rubber or other suitable viscoelastic cushioning that prevents bodily injury caused by straps and tape that bind both arms to an arm board; and rollaway tables, stands, shelves, and other devices not specifically designed to support the arms. Furthermore, the cushions protect the patient from injuries sustained from bodily contact with assemblies constructed of metal and other hard parts during placement, positioning, and removal of these devices; and unintended malfunction or collapse during a surgical procedure. Additionally, the cushions avoid the expense of using more than one device to support the arms of a patient lying on their side and reduces the time required to achieve these positions.

While the above description contains many specificities, these should not be construed as limitations on the scope of the invention, but as exemplifications of the presently preferred embodiments thereof. Many other ramifications and variations are possible within the teachings of our invention. Modifications in a wide variety of ways to the precise dimensions, depth, shape, and cross-sectional area of the furrows can be made and still fall within the spirit of our device. For example, the furrows can be triangular, oval, square, rectagonal, and other regular or irregular shape, either level or not level to a horizontal plane of the operating table, and provide support and access to the arms of the patient of various sizes, shapes, and disabilities; and accommodate the common practice of placing cushioning between an axilla of the lower arm and the top of the operating table when the patient is lying on their side.

In addition, the bottom and top cushions do not have to align as described and may slide with respect to each other to maximize support and access to the arms and provide unhindered access to the nasopharyngeal cavities for the patient of various sizes, shapes, and disabilities. Modifications in a wide variety of ways to the dimensions and shapes of the cut off corners of each cushion can be made and still fall within the spirit of our device so that access to the nasopharyngeal cavities of the patient of various sizes, shapes, and disabilities can be accommodated.

Furthermore, the cushions may be stacked or not stacked, together or separately, and in a plurality of orientations to provide access and support to the arms and legs. The cushions can also be used attached to an arm board secured to any side of the operating table or placed contiguously on the surface of the table without using an arm board. The cushions may be disposable or reusable, not covered or covered with a soft fabric material, and attached to each other by hook-and-loop fasteners or by hinges, and still fall within the scope of the claims. In addition, a flat lid for resting devices such as surgical scissors, forceps, and needle holders may be attached by either hook-and-loop fasteners or by hinges to the top side of the cushion that is not stacked, or to the top side of the top cushion when the cushions are stacked.

Use of our cushions is not limited to surgical procedures and can be used to support the arms and legs on an arm board attached to various types of patient supports, such as hospital or ordinary beds, and massage, chiropractic, or acupuncture tables, where a user must lie in the lateral or semi-lateral positions with their arms extended generally perpendicular to their torso. Therefore, the term "operating table" as used in the description of our device should be understood to mean any type of patient support, such as a surgical table, treatment table, chair, stretcher, back board, or bed. For example, our cushions may be attached to an arm board attached to a back board used to rescue and transport an injured patient who is best suited for travel on their side to prevent further bodily harm.

Furthermore, our cushions can be used to support an extremity of a non-human animal as can be used by those skilled in the art of veterinary medicine.

Thus the scope of the invention should be determined by the appended claims and their legal equivalents, and not by the examples given.

What is claimed is:

1. A support for the arms of a person lying on their side, where said person has upper and lower arms that are generally parallel, extend in a direction generally perpendicular to said person's torso, and have a predetermined spacing, comprising:

a resilient member having an upper elongated cushion facing upward for said upper extended arm and a lower elongated cushion facing upward toward said upper elongated cushion for said lower extended arm, each cushion having overall dimensions of rectangular shape to be mounted on top of a surgical arm board or operating table;

wherein the upper and lower cushions are stacked to form the resilient member;

said upper and lower cushions being a predetermined distance apart corresponding generally to said predetermined spacing;

said upper and lower cushions of said stacked cushions each comprise an elongated member along a longitudinal furrow which extends from one planar face to an opposite planar face, having a constant width along the length of the cushion;

whereby said resilient member provides comfortable support and access to said arms, and facilitates access to the nasopharyngeal cavities of said person.

2. The support of claim 1 wherein said pair of said stacked cushions comprises lightweight viscoelastic foam material.

3. The support of claim 1, further including a pair of mating hook-and-loop fasteners for removably attaching said stacked cushions together.

4. The support of claim 1, further including a pair of mating hook-and-loop fasteners for removably attaching said stacked cushions to said arm board or operating table.

5. The support of claim 1 wherein each longitudinal furrow has predetermined dimensions for facilitating access to said arms for placement, removal, and maintenance of a multitude of medical devices.

6. The support of claim 1 wherein each longitudinal furrow has predetermined dimensions for said arms, whereby said person can moveably adjust safely within each said rest or cradle during repositioning of said person, arms, cushions, or arm board.

7. The support of claim 1 wherein said stacked cushions each has triangular cut off corners having predetermined dimensions nearest said person's head for facilitating access to said nasopharyngeal cavities for placement, removal, and maintenance of said multitude of medical devices, the triangular cut off corners of said stacked upper and lower cushions being contiguous.

8. The support of claim 1 wherein said support is selected from the class consisting of disposable and reusable supports.

* * * * *